US010968018B2

(12) United States Patent
Milbrandt et al.

(10) Patent No.: US 10,968,018 B2
(45) Date of Patent: Apr. 6, 2021

(54) TWIST TIE DISPENSING APPARATUS AND METHOD

(71) Applicant: Bedford Industries, Inc., Worthington, MN (US)

(72) Inventors: Kim A. Milbrandt, Worthington, MN (US); Debra Kay Houseman, Sioux Falls, SD (US); Jeffery Scott Maltas, Sibley, IA (US); Colin O'Donnell, Bigelow, MN (US); Joshua Platt, Bigelow, MN (US); David Schiller, Sioux Falls, SD (US); Jeffrey Tschetter, Sioux Falls, SD (US)

(73) Assignee: BEDFORD INDUSTRIES, INC., Worthington, MN (US)

( * ) Notice: Subject to any disclaimer, the term of this patent is extended or adjusted under 35 U.S.C. 154(b) by 616 days.

(21) Appl. No.: 15/323,175

(22) PCT Filed: Jul. 2, 2015

(86) PCT No.: PCT/US2015/039049
§ 371 (c)(1),
(2) Date: Dec. 30, 2016

(87) PCT Pub. No.: WO2016/004343
PCT Pub. Date: Jan. 7, 2016

(65) Prior Publication Data

US 2017/0129670 A1 May 11, 2017

Related U.S. Application Data

(60) Provisional application No. 62/020,535, filed on Jul. 3, 2014.

(51) Int. Cl.

| | |
|---|---|
| ***B65D 63/12*** | (2006.01) |
| ***B65D 73/00*** | (2006.01) |
| ***A47F 13/00*** | (2006.01) |

(52) U.S. Cl.
CPC ..... *B65D 63/12* (2013.01); *A47F 13/00* (2013.01); *B65D 73/0064* (2013.01); *B65D 73/0071* (2013.01); *B65D 2203/00* (2013.01)

(58) Field of Classification Search
CPC ..... B65D 63/12; B65D 85/1063; B65D 73/0064; B65D 73/0071; B65D 2203/00;
(Continued)

(56) References Cited

U.S. PATENT DOCUMENTS 1,728,509 A * 9/1929 Rahe ..... A24F 27/12 206/103
2,755,576 A * 7/1956 Golden ..... G09F 1/10 248/205.3

(Continued)

FOREIGN PATENT DOCUMENTS

EP 3164339 A1 5/2017

OTHER PUBLICATIONS

International Search Report dated Sep. 25, 2015, for corresponding International Application No. PCT/US2015/039049, filed Jul. 2, 2015.

(Continued)

*Primary Examiner* — Anthony D Stashick
*Assistant Examiner* — James M Van Buskirk
(74) *Attorney, Agent, or Firm* — Mai-Tram D. Lauer; Westman, Champlin & Koehler, P.A.

(57) ABSTRACT

An apparatus (100, 200, 400, 500, 600) includes a stack (110, 310) having a plurality of connected tie web sheets (106, 306) and an image (114) disposed on each of the tie web sheets (106, 306), wherein the image (114) is the same on each tie web sheet (106, 306) and is disposed in overlay registration from sheet (106, 306) to sheet (106, 306). Each tie web sheet (106, 306) includes a plurality of twist ties (104, 304), each twist tie (104, 304) having a proximal end
(Continued)

(118) and a distal end (120), each twist tie (104, 304) being removably attached to the stack (110, 310) at its proximal end (118). A method of dispensing a plurality of twist ties (104, 304) includes mounting a stack (110, 310) within reach of a user and displaying an image (114) disposed on each of the tie web sheets (106, 306). Removal of a twist tie (104, 304) of the plurality of twist ties (104, 304) of the stack (110, 310) does not alter the image (114) viewable by the user.

12 Claims, 9 Drawing Sheets

(58) Field of Classification Search
CPC ..... B65D 75/527; A47F 13/00; G09F 1/10; G09F 3/20; G09F 3/204; Y10S 206/806; Y10S 493/962; F16B 15/00
USPC ..... 206/308, 90; 220/504, 503, 266, 265; 40/674
See application file for complete search history.

(56) References Cited

U.S. PATENT DOCUMENTS 3,753,305 A * 8/1973 Mueh ..... G09F 1/10 206/806
4,529,636 A 7/1985 Olson
4,948,202 A 8/1990 Helseth
D323,594 S 2/1992 Helseth
5,092,830 A 3/1992 Helseth
5,112,083 A 5/1992 Morrone
5,232,431 A 8/1993 Helseth
5,748,608 A * 5/1998 Spector ..... G11B 23/40 206/308.1
D395,566 S 6/1998 Helseth
5,961,434 A 10/1999 Helseth
6,042,113 A * 3/2000 Walker ..... A24F 27/12 206/103
6,217,500 B1 * 4/2001 Helseth ..... A47F 13/085 221/26
6,651,369 B1 11/2003 Keating
6,920,979 B2 * 7/2005 Chandaria ..... B65D 73/0064 206/397
9,206,007 B2 12/2015 Helseth
2006/0261077 A1 * 11/2006 Bodziak ..... B42D 5/005 221/33
2009/0188824 A1 * 7/2009 Velazquez ..... B65D 5/543 206/438
2013/0134181 A1 5/2013 Helseth
2015/0034513 A1 2/2015 Helseth
2016/0016752 A1 1/2016 Helseth
2017/0129672 A1 * 5/2017 Helseth ..... A47F 13/04

OTHER PUBLICATIONS

Written Opinion of the International Searching Authority dated Sep. 25, 2015, for corresponding International Application No. PCT/US2015/039049, filed Jul. 2, 2015.
Examination Report issued by the European Patent Office dated Jan. 3, 2019, in corresponding European application No. 18151339.1.
Esteva, Andres, Letter from Mexican Associate setting forth substance of Jan. 30, 2020 Office Action, letter dated Feb. 10, 2020.

* cited by examiner

TWIST TIE DISPENSING APPARATUS AND METHOD

BACKGROUND

Twist tie dispensing devices are often used in grocery stores and other stores where groceries and other bulk products are placed in plastic bags to be carried and temporarily closed or sealed so as to prevent spillage and soiling of the contents. In a typical grocery store, twist tie dispensing devices are normally placed near a roll of plastic bags, which is next near the items to be bagged. Such twist tie dispensing devices are generally placed in locations throughout the store.

A twist tie is conventionally used to close an opening of a bag, such as a garbage bag or bread bag. The two ends of the twist tie are wrapped around a narrowed or cinched portion of the bag; then the two ends of the tie are twisted together. Items in grocery stores and other stores that are commonly closed in plastic bags include, for example, produce, meat packages, baked goods, candies, fruits, vegetables, nuts, and snacks.

Twist ties are generally made out of a metal wire encased within one or more strips of paper and/or plastic. The strength of the wire varies depending upon the application for which the twist tie is to be used. The paper or plastic casing protects a user from the wire ends, which often are sharp, and provides "wings" on each side of the wire to facilitate the manipulation of the twist tie for closure, opening and reclosure of a bag. Twist ties can also have a wide covering that extends on either or both sides of the wire like a flag-shaped panel. These types of twist ties are most often used for labeling. Unlike other closure means, such as, for example, adhesive tape, twist ties can be re-used.

Different sizes and strengths of twist ties are used in different applications. For example, short and thin twist ties may be used to close a bag of bread, whereas long and wide twist ties may be used to secure garden hoses in place.

In a dispensing device, layers of twist ties are typically arranged with individual twist ties in each layer disposed in a side-by-side configuration. Slits between individual ties of each layer, and perforations along an end of each tie facilitate the removal of the ties from a dispensing device.

SUMMARY

In one aspect, an apparatus comprises a stack comprising a plurality of connected tie web sheets and an image disposed on each of the tie web sheets, wherein the image is the same on each tie web sheet and is disposed in overlay registration from sheet to sheet. Each tie web sheet comprises a plurality of twist ties, each twist tie having a proximal end and a distal end, each twist tie being removably attached to the stack at its proximal end.

In another aspect, a method of dispensing a plurality of twist ties comprises mounting a stack comprising a plurality of connected tie web sheets within reach of a user and displaying an image disposed on each of the tie web sheets. Each tie web sheet comprises at least some of the plurality of twist ties, each twist tie having a proximal end and a distal end, each twist tie being removably attached to the stack at its proximal end. The image is the same on each tie web sheet and is disposed in overlay registration from sheet to sheet. Removal of a twist tie of the plurality of twist ties of the stack does not alter the image viewable by the user.

Moreover, the disclosure, in its various combinations, either in apparatus or method form, may also be characterized by the following listing of items:

1. An apparatus, comprising:

a stack comprising a plurality of connected tie web sheets, wherein each tie web sheet comprises a plurality of twist ties, each twist tie having a proximal end and a distal end, each twist tie being removably attached to the stack at its proximal end; and an image disposed on each of the tie web sheets, wherein the image is the same on each tie web sheet and is disposed in overlay registration from sheet to sheet.

2. The apparatus of item 1, further comprising a backer card having a front surface, wherein the stack is attached to the backer card and is positioned on the front surface of the backer card, wherein the image is disposed on the front surface of the backer card in overlay registration with the image disposed on each of the plurality of tie web sheets.

3. The apparatus of any of items 1-2, wherein the image spans across at least some of the plurality of twist ties.

4. The apparatus of any of items 1-3, wherein the plurality of tie web sheets are connected by a repositionable adhesive.

5. The apparatus of any of items 1-4 further comprising a hang tab.

6. The apparatus of any of items 1-5 further comprising a shelf bracket.

7. The apparatus of any of items 1-6, further comprising a container that surrounds at least the proximal ends of the plurality of twist ties.

8. The apparatus of item 7, wherein at least a first portion of the image is disposed on the container.

9. The apparatus of item 8, wherein the container comprises a first perforation line demarcating a first portion of the container and a second portion of the container;

wherein the first portion of the image is disposed on the first portion of the container; and wherein a second portion of the image is disposed on the second portion of the container.

10. The apparatus of item 9, wherein the container comprises a second perforation line demarcating the second portion of the container and a third portion of the container;

wherein the first portion of the image is disposed on the third portion of the container.

11. The apparatus of item 10, wherein the first portion of the image disposed on the third portion of the container is a flipped version of the first portion of the image disposed on the first portion of the container.

12. A method of dispensing a plurality of twist ties, comprising:

mounting a stack comprising a plurality of connected tie web sheets within reach of a user, wherein each tie web sheet comprises at least some of the plurality of twist ties, each twist tie having a proximal end and a distal end, each twist tie being removably attached to the stack at its proximal end; and displaying an image disposed on each of the tie web sheets, wherein the image is the same on each tie web sheet and is disposed in overlay registration from sheet to sheet;

wherein removal of a twist tie of the plurality of twist ties of the stack does not alter the image viewable by the user.

13. The method of item 12, wherein mounting the stack comprises suspending the stack from a retention mechanism.

14. The method of any of items 12-13, wherein mounting the stack comprises attaching the stack to a shelf.

15. The method of any of items 12-14, wherein removal of the twist tie comprises breaking a bond of a repositionable adhesive.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views. Moreover, analogous structures may be indexed in increments of one hundred. It is contemplated that all descriptions are applicable to like and analogous structures throughout the several embodiments.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

Figure 1:
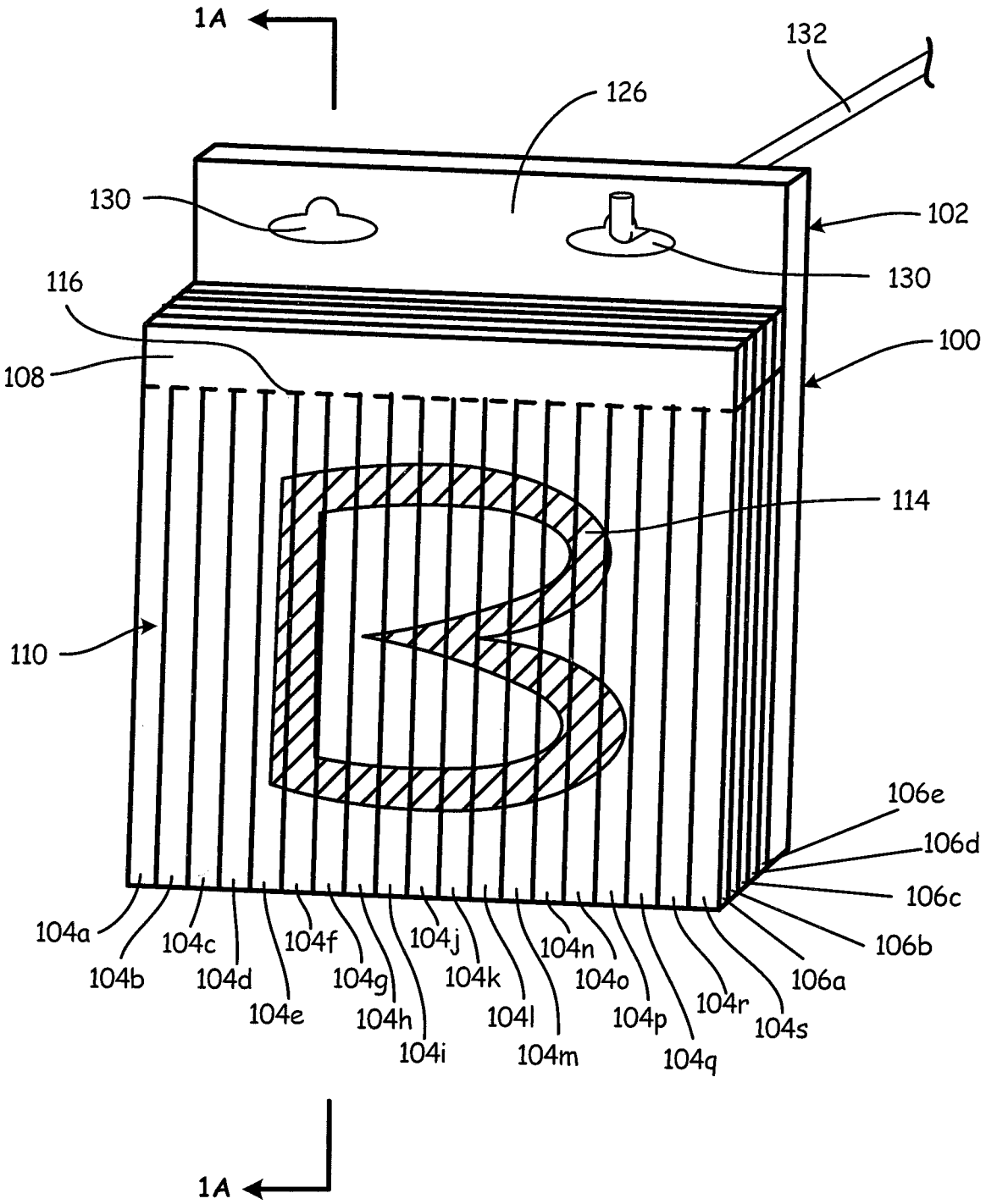
FIG. 1 is a front perspective view of an exemplary embodiment of a twist tie dispensing apparatus.
Figure 1A:
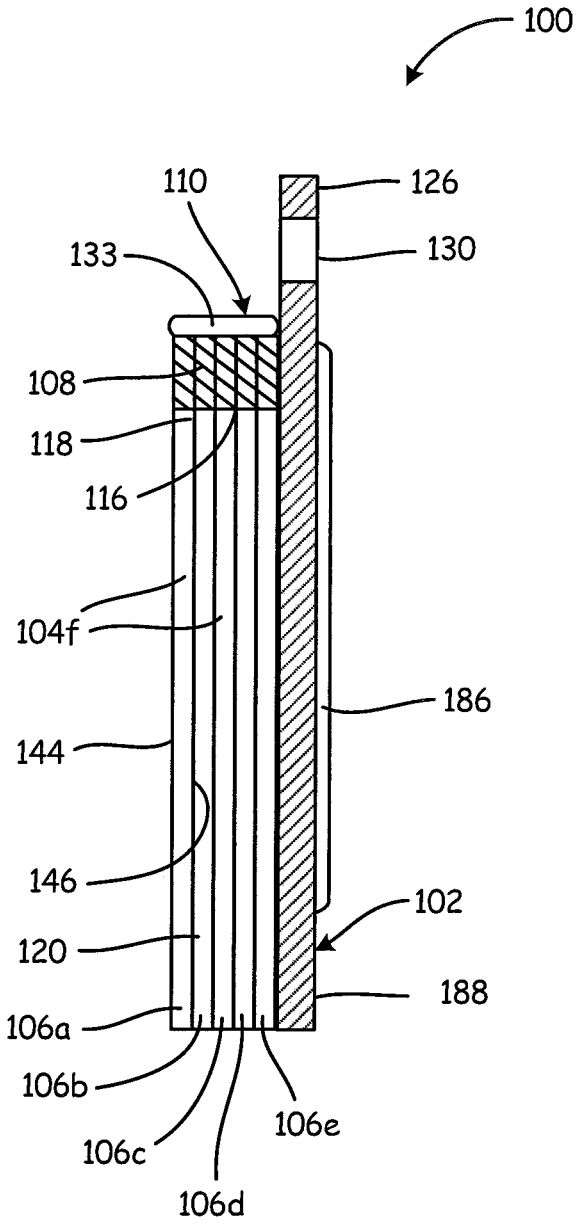
FIG. 1A is a sectional view, as taken along line 1A-1A of FIG. 1.

The present disclosure describes twist tie dispensing apparatuses for packaging bulk quantities of twist ties and dispensing individual twist ties. Such an apparatus is mounted within reach of a user to allow the user to obtain an individual twist tie therefrom. FIGS. 1 and 1A illustrate a twist tie dispensing apparatus 100 configured to package bulk quantities of twist ties in their non-twisted state and allow users to easily obtain individual twist ties therefrom.

Figure 2:
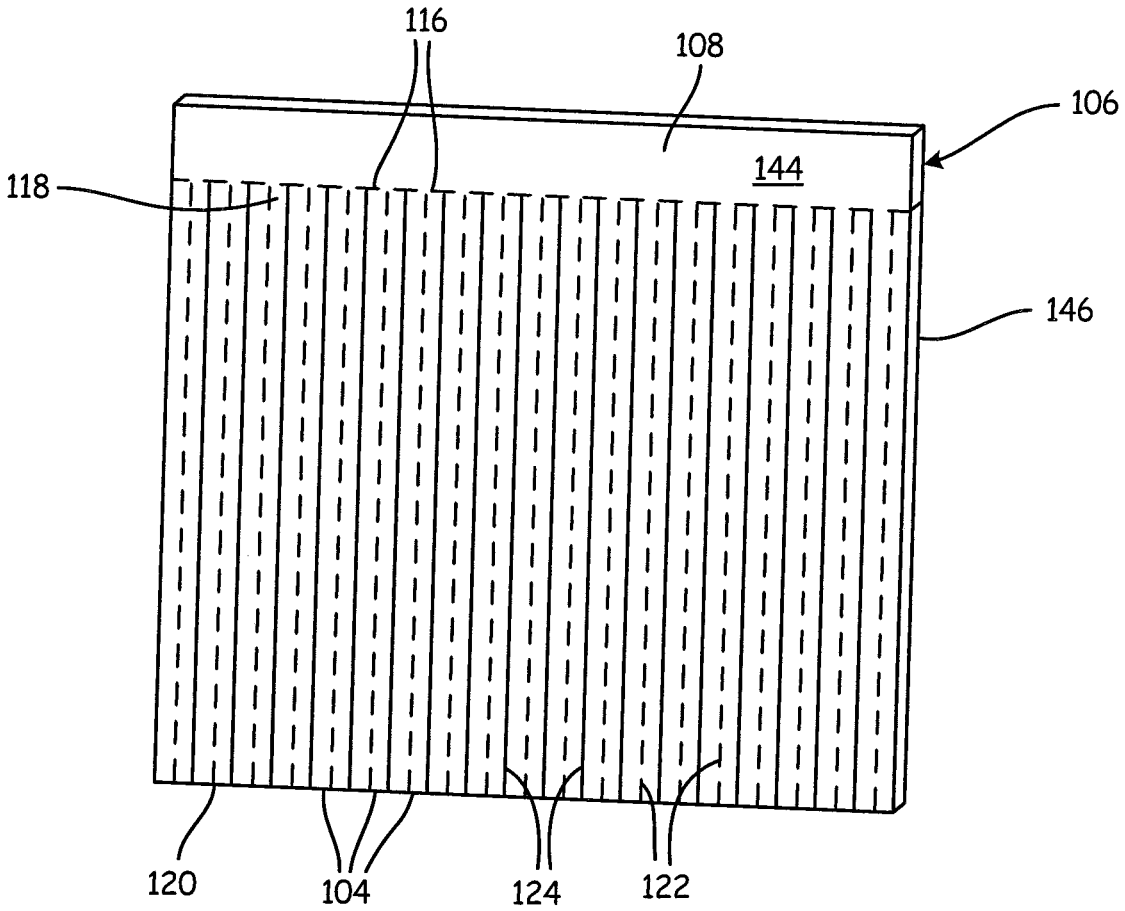
FIG. 2 is a front perspective view of a tie web sheet including a plurality of connected twist ties.

FIG. 2 is a front perspective view of a web sheet 106 including a plurality of twist ties 104, which are joined to each other at waste header 108. Each tie web sheet 106 includes perforations 116 separating the waste header 108 from a plurality of twist ties 104. Each tie web sheet 106 has a front surface 144 facing the user and an opposite back surface 146. Each twist tie 104 extends from a proximal end 118 to a distal end 120. The twist ties 104 extend parallel to each other on a tie web sheet 106, typically either in a horizontal or a vertical orientation, depending upon the orientation of the tie web sheet 106 in a dispensing apparatus. Each twist tie 104 has a proximal end 118 removably attached to the waste header 108 and a distal end 120 that can be pulled by a user in order to detach the individual twist tie 104 at perforation 116 and remove the twist tie 104 from a pack of twist ties 110 (labeled in FIGS. 1 and 1A).

A metallic or polymeric wire 122 is embedded within each individual twist tie 104 (typically, the wires 122 extend past the perforations 116 (i.e., above the perforations 116 as viewed in FIG. 2) but are not shown in the waste header 108 in FIG. 2). A line of weakness such as a line of perforations 116 extends across each tie web sheet 106 in such a way that each perforation 116 severs all the way across each of the wires 122 but perforates only portions of the tie web sheet 106 at regular intervals. Such a line of weakness can also be accomplished with slits, scoring, and other known methods. Thus, the twist ties 104 of a tie web sheet 106 stay intact until an individual twist tie 104 is purposely separated from its respective web sheet 106 by a user.

As shown in FIG. 1, in an exemplary embodiment, twist tie dispensing apparatus 100 includes a backer card 102 that supports a stack of tie web sheets 106 that are bound together at a waste header 108. The connected set of tie web sheets 106 may be referred to as twist tie stack 110. In one embodiment, tie web sheets 106 are bound together by adhesive layer 133 on a top surface of the stacked waste headers 108 (see FIG. 1A, but not shown in FIG. 1). In another embodiment, tie web sheets 106*a-e* are attached to each other via adhesive disposed on one or both of front surface 144 and back surface 146 of individual tie web sheets 106 in the area of waste header 108. Such adhesive may be a conventional pressure sensitive adhesive or a low-tack repositionable adhesive, for example. Other means and methods for attaching a plurality of tie web sheets 106 to each other to form twist tie stack 110 can also be used. Moreover, adhesive layers as described can also be used to attach the twist tie stack 110 to a front surface of backer card 102.

As shown in FIG. 1A, adhesive layer 186, composed of a repositionable or more aggressive adhesive, is provided on a back surface 188 of the backer card 102 that faces away from the twist tie stack 110. The adhesive layer 186 can be applied to all of the back surface 188 or only to a portion thereof (as shown, for example).

In FIG. 2, the tie web sheet 106 is oriented so that waste header 108 is oriented horizontally; thus, the twist ties 104 are arranged to hang vertically and side-by-side across each web sheet 106. In another exemplary embodiment, the tie web sheets 106 are oriented so that waste header 108 is oriented vertically in the dispensing apparatus 100; thus, the twist ties 104 extend side-ways from proximal end 118 to distal end 120 and are arranged next to each other vertically along each web sheet 106. Each individual twist tie 104 on its respective tie web sheet 106 is separated from another twist tie 104 on the same tie web sheet 106 by a slit 124. Depending upon the orientation of the tie web sheet 106 inside the dispensing apparatus 100, the slits 124 extend either vertically or horizontally along each tie web sheet 106. As illustrated in FIGS. 1 and 2, which show the slits 124 in a vertical configuration, each slit 124 begins at the line of perforation 116 on the tie web sheet 106 and extends to the distal end 120 of each twist tie 104.

As noted above, the twist tie 104 may have a metallic or polymer core "wire" 122, with paper or polymer "wings" disposed about the core to facilitate tactile manipulation of the twist tie 104. The properties of the wire 122, such as strength, length and thickness of the wire, depend upon the application for which the twist tie 104 is to be used. When used for closing plastic bags in grocery or convenience stores, the twist ties 104 can be short and thin, and the wire 122 can be susceptible to bending forces. In the case of securing garden hoses in place, for example, the twist ties 104 can be long and thick, and the wire 122 inside the twist ties 104 can be less susceptible to bending forces, such that the twist tie 104 can hold flexible tubes of the hose in place when, for instance, the tubes are placed in a looped configuration. In some embodiments, the twist tie may be in the form of a "flag tie," where a wing on a side of the wire 122 is an enlarged panel (such as, for example, to allow a user to write a product code or other information). In that case or other cases, the slits 124 between adjacent twist ties 104 may be non-linear.

According to one embodiment of the present disclosure, a front surface of the backer card 102 and a front surface 144 of each tie web sheet 106 are configured to continuously display the same image 114 to a viewer, even when the tie web sheets 106 are at various stages of twist tie removal. The image 114 can include a photograph or other graphics, printed letters, numbers or other visually-perceptible indicia in any language, or any combination thereof. In an exemplary embodiment, image 114 spans across many of the individual twist ties 104 of a tie web sheet 106. In one exemplary embodiment, the backer card 102 displays the image 114 on either or both of the front and back side of backer card 102. Providing image 114 on the front side of backer card 102 allows image 114 to be displayed even when all twist ties 104 are completely removed from twist tie dispensing apparatus 100. In an exemplary embodiment, image 114 is in aligned registration on each successive tie web sheet 106 so that the image 114 is continuously displayed on the twist ties 104 and the backer card 102, regardless of which individual twist ties 104 are removed on which tie web sheets 106. Thus, image 114 is uninterrupted whether a single column of twist ties 104 is partially or completely removed, or other randomly positioned twist ties 104 are removed.

By way of example, the dispensing apparatus 100 includes a backer card 102 and five tie web sheets 106*a-e*, where each tie web sheet 106 includes nineteen twist ties 104*a-s* arranged vertically. It is contemplated that any number of tie web sheets 106 can be used with a single dispensing apparatus 100, and each tie web sheet 106 can include any number of individual twist ties 104. In the illustrated embodiment, the tie web sheets 106*a-e* are attached to each other and backer card 102 in an overlaid (i.e., stacked) relation. In this illustrative example, the backer card 102 and each of the five tie web sheets 106*a-e* displays the image 114 of a stylized letter "B," and the image 114 is in overlay registration from one tie web sheet 106 to each successive tie web sheet 106 and backer card 102. Thus, in an exemplary embodiment, the portion of image 114 on twist tie 104*i* is identical on each of the tie web sheets 106*a-e* and backer card 102 at the position of twist tie 104*i*. This overlay registration applies to all of the twist ties 104*a-s* and all of the web sheets 106*a-e*, as well as backer card 102. Accordingly, a user can view an undistorted image 114, regardless of which individual twist ties 104 have been removed from twist tie dispensing apparatus 100.

By way of example, suppose that users completely remove the twist tie 104*g* of each tie web sheet 106*a-e*, remove the twist tie 104*h* on each of the first two web sheets 106*a* and 106*b*, remove the twist tie 104*i* on each of the first four tie web sheets 106*a*-106*d*, and remove none of the other twist ties 104*a-f* and 104*j-s*. Even though the twist ties on the tie web sheets 106*a-e* are at various depths of removal from apparatus 100, the image 114 is displayed without interruption to a user viewing the front surface 144 of any of the full or partial tie web sheets 106*a-e*. Image 114 remains perceptible and recognizable, even though one or more portions of the image 114 are being presented by different individual twist ties 104 of different tie web sheets 106 (or visible portions of the backer card 102). The imagery tolerance required to achieve such registration will depend upon the complexity of the image and on customer preference (e.g., on the preference of the customer whose promotional or informational image 114 is disposed on the dispensing apparatus 100, such as a trademark word, logo, store information, or a combination thereof). In one embodiment, an image registration tolerance among all tie web sheets 106 and backer card 102 in a range of 0.015 inch to 0.025 inch may be desired.

In an exemplary embodiment, backer card 102 provides structural support for the dispensing apparatus 100. In one embodiment, backer card 102 is formed from a relatively stiff material, such as cardboard, paper stock, wood, polystyernic thermoplastics (especially when composed or treated for good printing ink reception), polyolefinic thermoplastics, polyesters, and the like. Suitable thermoplastic materials include polymers of styrene, ethylene, and propylene, as well as a variety of other monomers and mixtures of monomers (e.g., to make co-polymers and ter-polymers, etc.). The polymers may be formulated so that printing inks are readily accepted on the surface of the sheet material. Backer card 102 may be processed with surface treatments to enhance acceptance of printing inks and other printing compositions. The exact structure and composition of backer card material for backer card 102 can vary widely.

In an exemplary embodiment, backer card 102 include a hang tag 126 extending beyond the dimensions of tie web sheets 106. In an exemplary embodiment, hang tag 126 includes one or more apertures 130, by which twist tie dispensing apparatus 100 is configured to be suspended from a retention mechanism 132, such as, for example, a hook or rod. While only one retention mechanism 132 is shown to allow for a clear view of aperture 130, it is contemplated that in use, a retention mechanism 132 is associated with each of apertures 130. Moreover, while two apertures 132 are illustrated, it is contemplated that more or fewer apertures may be provided in hang tag 126.

In the illustrated embodiment, image 114 is displayed on twist ties 104 and backer card 102. In another embodiment, a continuous image 114 may also extend from twist ties 104 and onto waste header 108. In yet another embodiment, a continuous image 114 may also extend from twist ties 104 onto waste header 108 and still further onto hang tab 126. This configuration allows for a continuous image 114 to appear overall generally consistently and constantly, even when some or all of the twist ties 104 have been removed from the tie web sheets 106.

Figure 3:
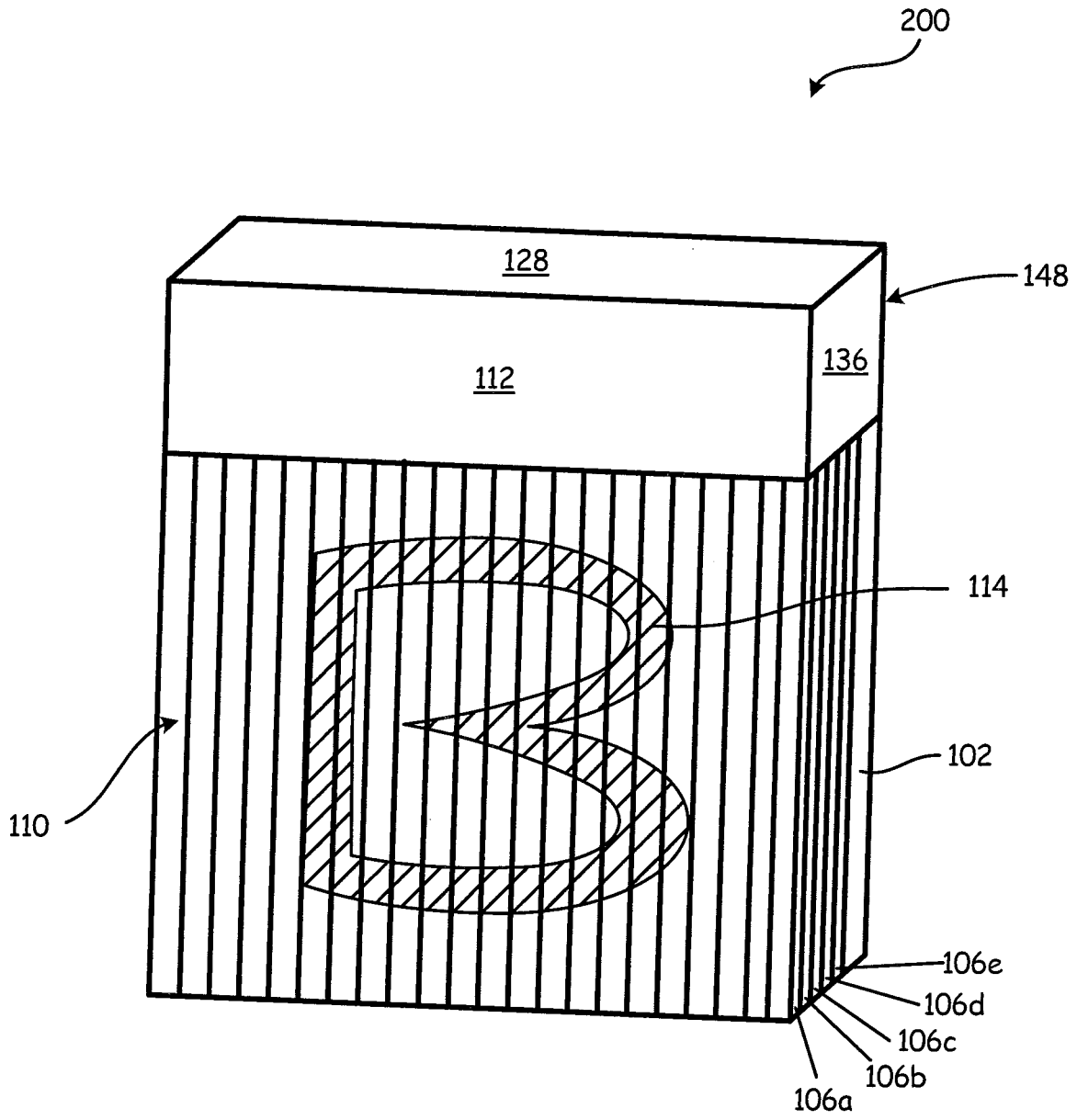
FIG. 3 is a front perspective view of an exemplary embodiment of a twist tie dispensing apparatus having a wrap-around header.

In another embodiment illustrated in FIG. 3, a dispensing apparatus 200 includes a partial container or wrap-around header 148 that wraps around the twist tie stack 110 adjacent the waste header 108. A front panel 112 of the header 148 can be adapted to display images such as image 114 described above. In a further embodiment, the front panel 112 of the header 148 can be configured to include a display that shows pricing and product information associated with products for sale in a store, for example. In a further embodiment, images and information can also be displayed on top panel 128 and side panels 136 of header 148. An exemplary embodiment of dispensing apparatus 200 includes hang tab 126 having retention apertures 130 integrally formed with backer card 102, as described above with reference to dispensing apparatus 100, although such structures are not visible in FIG. 3 because they are located behind header 148.

In the illustrated embodiment, image 114 is displayed on twist ties 104 and backer card 102. In another embodiment, a continuous image 114 may also extend from twist ties 104 and onto front panel 112. This configuration allows for a continuous image 114 to appear overall generally consistently and constantly, even when some or all of the twist ties 104 have been removed from the tie web sheets 106.

Figure 4:
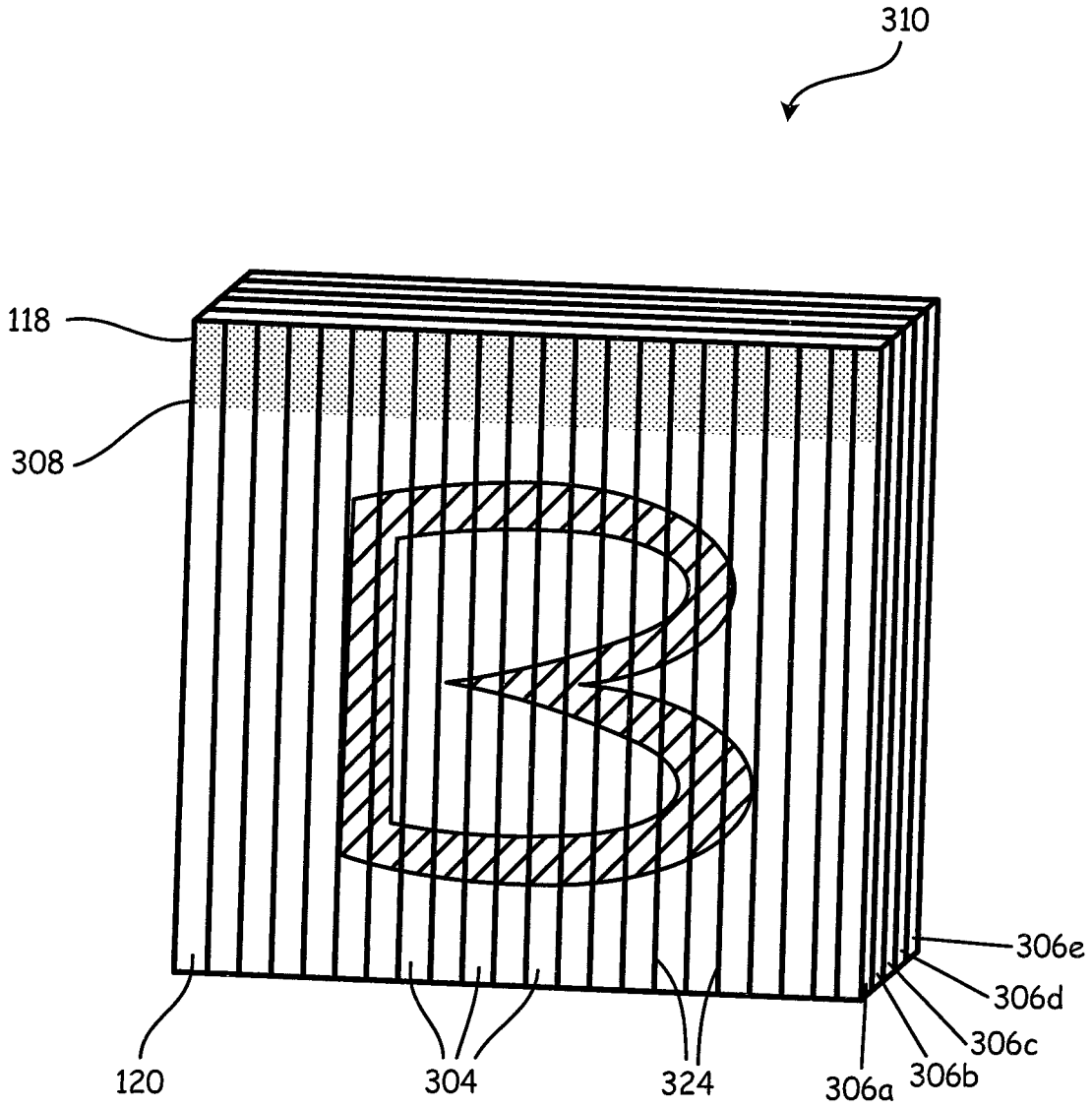
FIG. 4 is a front perspective view of an exemplary embodiment of a twist tie stack having repositionable adhesive.

According to an alternative embodiment of twist tie stack 310 illustrated in FIG. 4, a plurality of tie web sheets 306 are removably secured to one another using repositionable adhesive 308 disposed on one or both sides of each tie web sheet 106 (typically in a band near a proximal end 118 of twist ties 304). With this configuration, there are no perforations across twist ties 304 or their wires and no waste header. Accordingly, slits 324 separating adjacent twist ties 304 extend fully from proximal end 118 to distal end 120 between adjacent twist ties 304. In one exemplary embodiment, the repositionable adhesive 308 connects each tie web sheet 306 to an adjacent tie web sheet 306 (or, in the case of the bottom-most tie web sheet 306*e*, to the backer card 102 (shown in FIG. 1, for example)). Removal of an individual twist tie 304 involves breaking the bond of the repositionable adhesive between the twist tie 304 to be removed and the underlying twist tie 304 of the adjacent tie web sheet 306.

Figure 5:
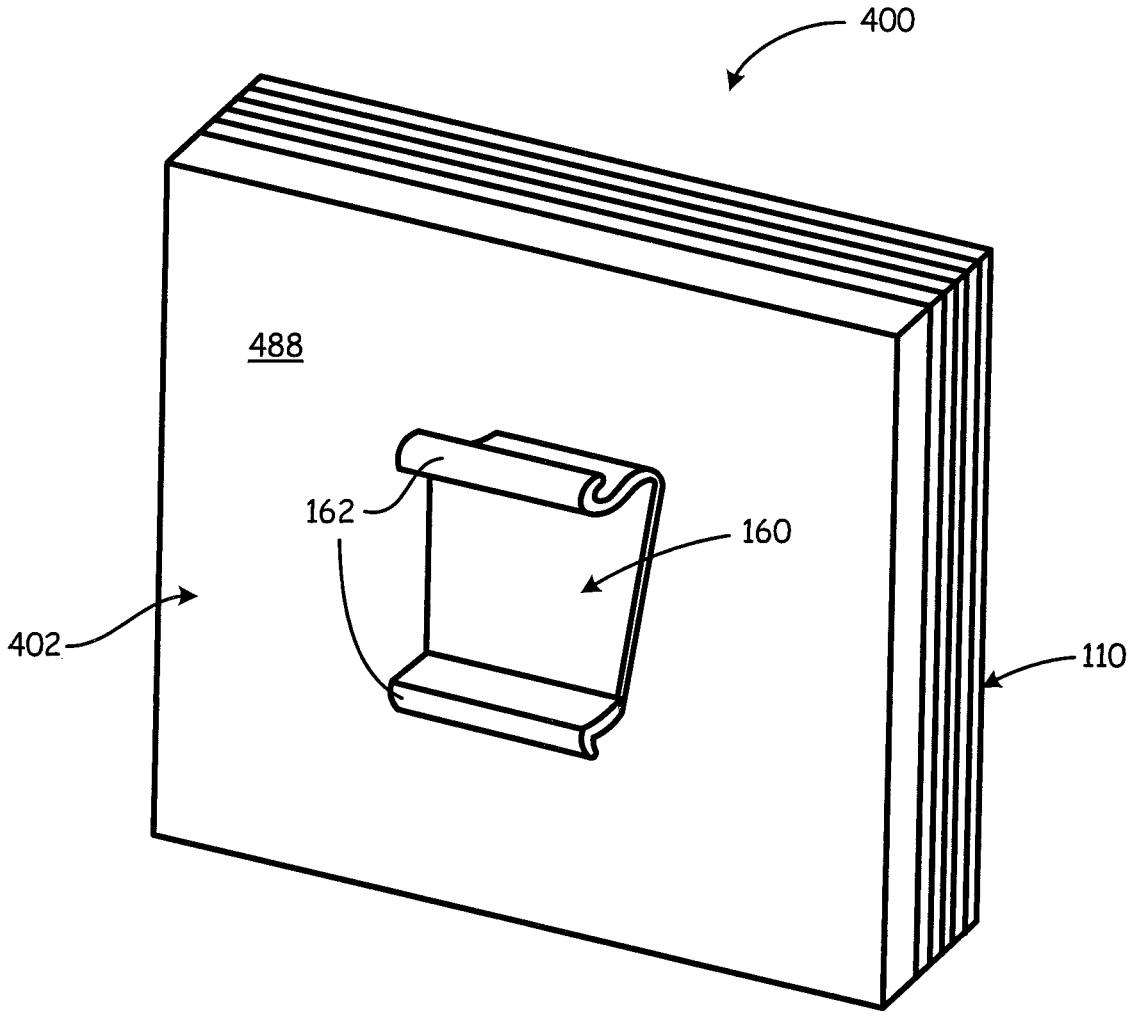
FIG. 5 is a rear perspective view of an exemplary embodiment of a twist tie dispensing apparatus having a shelf bracket.

In a further embodiment of a twist tie dispensing apparatus 400 illustrated in FIG. 5, backer card 402 is attached to twist tie stack 110 in the manner described above with reference to backer card 102. Dispensing apparatus 400 includes a shelf bracket 160 adapted to attach the apparatus 400 in place to the front edge of a shelf of typical grocery or convenience store shelving (not illustrated). Such a shelf bracket is shown in U.S. Pat. No. 6,651,369, for example. Shelf bracket 160 is secured to the back surface 488 of the backer card 402 using known methods and means, such as the use of adhesives, for example. The length and thickness of the shelf bracket 160 can depend upon the size of the shelf edge that the shelf bracket 160 is configured to snap onto. In one embodiment, shelf bracket 160 has an elongated lip 162 configured to snap into or onto a shelf channel. Elongated lip 162 extends parallel to the shelf channel. Once shelf bracket 160 is snapped into the shelf channel, the lips 162 allow for shelf bracket 160, and therefore twist tie dispensing apparatus 400, to be slid horizontally along a length of the shelf channel as desired.

Figure 6:
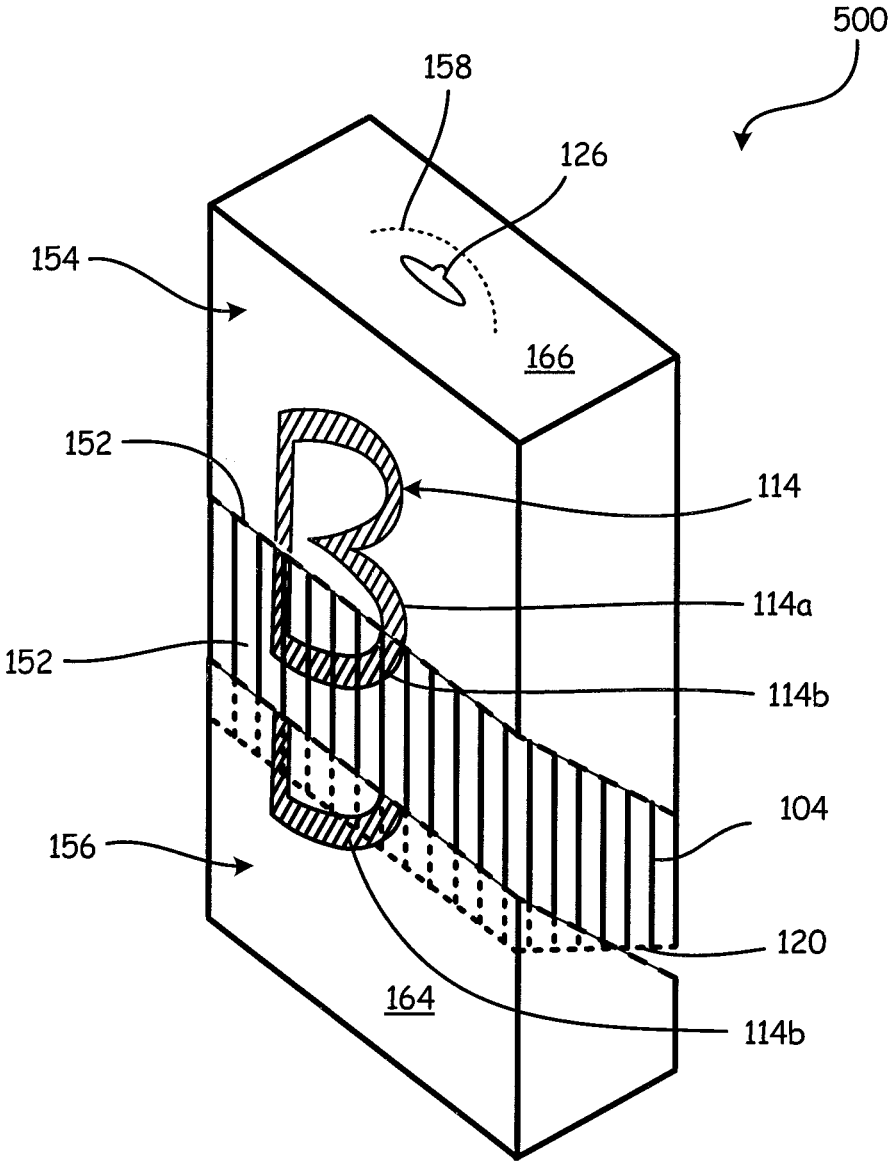
FIG. 6 is a front perspective view of an exemplary embodiment of a twist tie dispensing apparatus having a lower box portion that is configured to be discarded.

In another exemplary embodiment illustrated in FIG. 6, a twist tie dispensing apparatus 500 includes a container or integral box 150 having perforation line 152 that allows separation of box 150 into an upper box portion 154 and a lower box portion 156. Upper box portion 154 is secured to a store fixture (not illustrated) via a hang tag 126, shelf bracket 160, or other fastening mechanism, such as, for example, a J-hook, an adhesive layer, or a channel tab. In an exemplary embodiment, hang tag 126 is formed in plane with end surface 166 of box 150 but can be lifted via line of weakness 158 to an orientation substantially perpendicular to end surface 166.

In the illustrated embodiment, lower box portion 156 covers and protects the distal ends 120 of twist ties 104 during transport from the factory to the store. Once the dispensing apparatus 500 is set in place and fastened to the retail fixture, however, the lower box portion 156 is separated from the upper box portion 154 along perforation line 152 and can be discarded. A line of weakness such as a perforation line 152 can also be accomplished with slits, scoring, and other known methods. Thus, box 150 remains intact until upper box portion 154 and lower box portion 156 are purposely separated by a user. In this case, the user is typically a store employee in an exemplary embodiment.

FIG. 6 shows the a state in which upper box portion 154 and lower box portion 156 have been separated and are being moved apart, so that twist ties 104 are visible, hanging from upper box portion 154. Twist ties 104 can be part of stack 110 illustrated in FIG. 1 or stack 310 illustrated in FIG. 4, for example. Such a stack 110, 310 may be attached to upper box portion 154 by any known method, such as by the use of adhesives, for example.

According to this illustrative embodiment of twist tie dispensing apparatus 500, the lower box portion 156 is removably attached to the upper box portion 154 and protects the ties 104 (which are in their non-twisted state) from bending or inadvertent separation; in apparatus 500, twist ties 104 are not exposed until the twist ties 104 are ready to be dispensed.

As shown in FIG. 6, box 150 has image 114 provided on front surface 164, such as by printing. An upper portion 114*a* of the image 114 is provided on upper box portion 154 and a lower portion 114*b* of image 114 is provided on lower box portion 156. When the upper box portion 154 and the lower box portion 156 are connected along perforation line 152, the image 114 of a stylized capital letter "B" appears uninterrupted on the front surface 164. In an exemplary embodiment, twist ties 104 also have at least lower portion 114*b* of image 114 provided thereon. Accordingly, even after lower box portion 156 has been removed and discarded, a viewer of the remaining upper box portion 154 and twist ties 104 observes an uninterrupted image 114. In an exemplary embodiment, overlay registration of the image 114 is provided on box 150 and twist ties 104. In an exemplary embodiment, a tie web sheet 106 providing the twist ties 104 is printed with the entire image 114, even if only the lower portion of the image 114*b* is visible in use. In an exemplary embodiment, a visible image portion 114*b* on twist ties 104 is identical to an image portion 114*b* on lower box portion 156.

Figure 7:
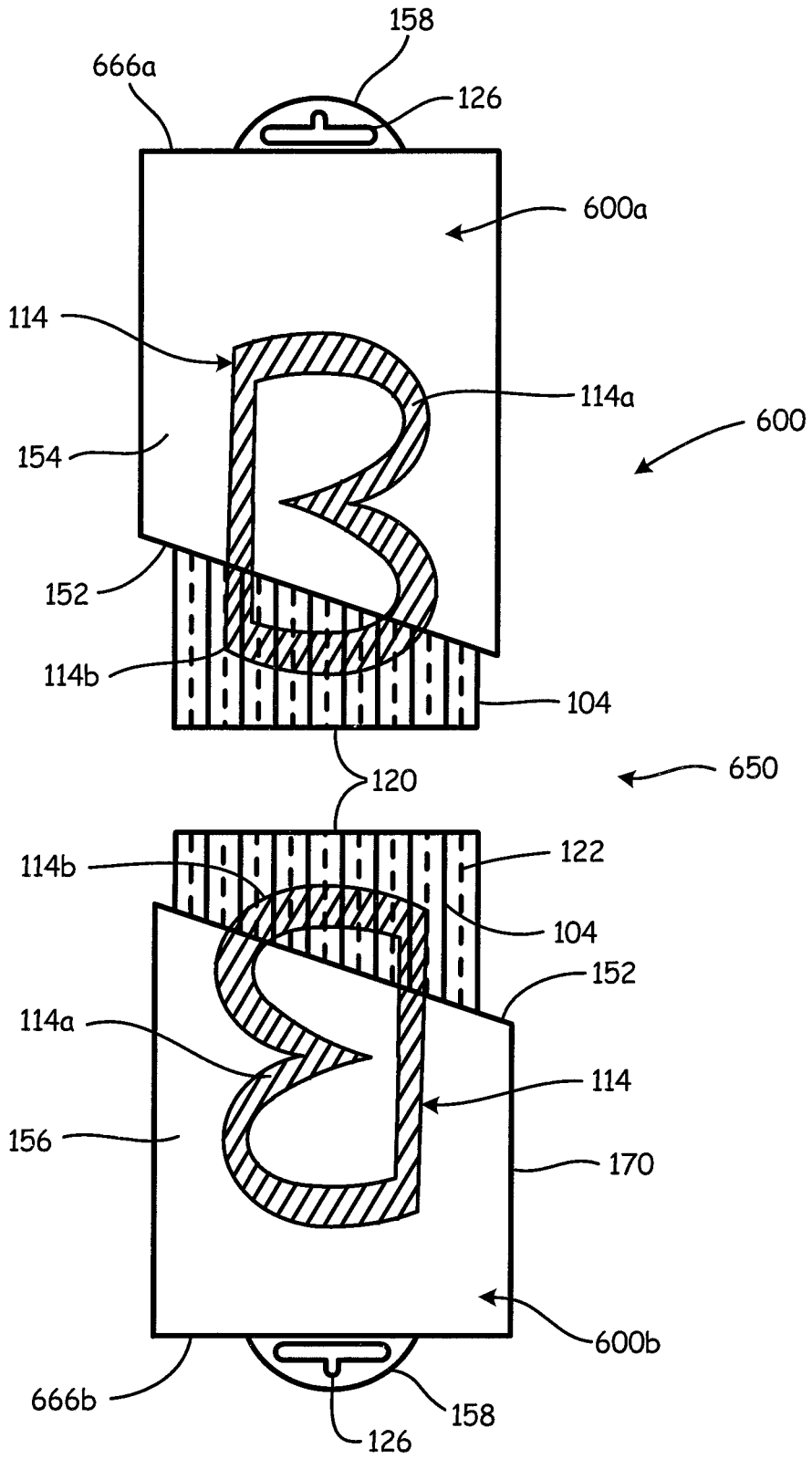
FIG. 7 is a front view of a twist tie dispensing apparatus according to a further embodiment that provides for two identical usable dispensing assemblies from one box.
Figure 8:
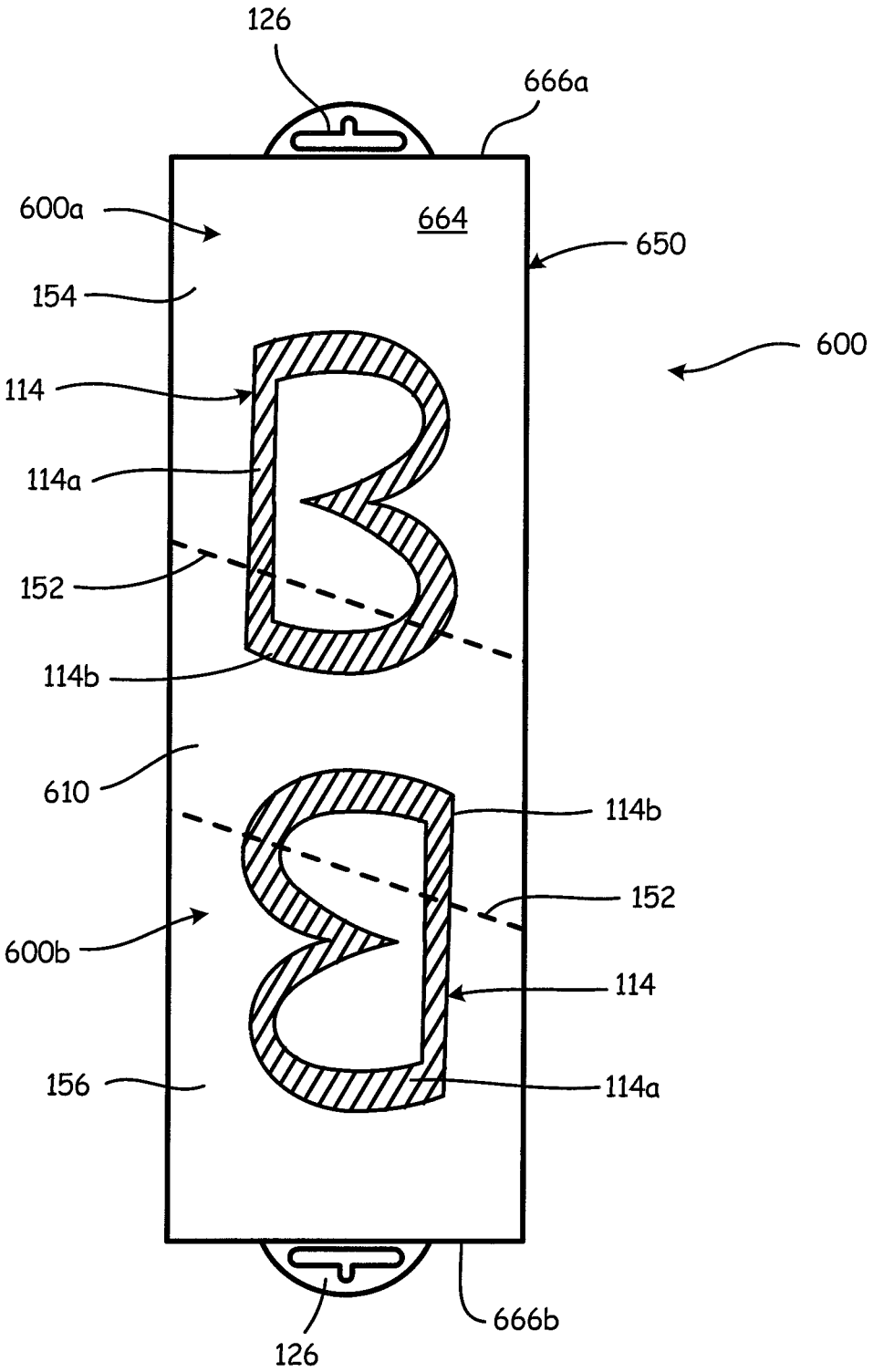
FIG. 8 is a front view of the box of FIG. 7 before separation into two dispensing assemblies.

As shown in FIG. 7, yet another embodiment of twist tie dispensing apparatus 600 includes container or box 650. Both upper box portion 154 and lower box portion 156 of box 650 include hang tags 126 and a stack of twist ties 104, allowing such a box 650 to be split into two usable dispensing apparatuses 600*a*, 600*b*. The upper box portion 154 and lower box portion 156 of box 650 are separated from each other and an intermediate panel 610 (shown in FIG. 8) along perforation lines 152. Upper box portion 154 serves as dispensing apparatus 600*a* and lower box portion 156 serves as dispensing apparatus 600*b*. Each of the separated dispensing apparatuses 600*a*, 600*b* can be secured to a retail fixture (not illustrated) via a hang tag 126, shelf bracket 160, or other fastening mechanism, such as, for example, a J-hook, an adhesive layer, or a channel tab.

Twist ties 104 are disposed in each box portion 154 and 156. Twist ties 104 can be part of stack 110 illustrated in FIG. 1 or stack 310 illustrated in FIG. 4, for example. Such a stack 110, 310 may be attached to upper box portion 154 and lower box portion 156 by any known method, such as by the use of adhesives, for example.

The twist ties 104 can be perforated or cut apart at distal ends 120. The proximal ends 118 of the twist ties 104 are engaged in and/or retained to each respective box portion 154, 156 until a user separates each twist tie 104 from the respective dispensing apparatus 600*a*, 600*b*. Once upper box portion 154, lower box portion 156, and intermediate panel 610 are separated, the end result is two identical dispensing assemblies 600*a*, 600*a* that were originally connected as a single box 650. In an exemplary embodiment, intermediate panel 610 extends between the upper box portion 154 and the lower box portion 156 and around the entire box 650. In a typical use, intermediate panel is discarded after being separated from box 650 along perforation lines 152. Twist tie dispensing apparatus 600 prevents unwanted exposure of the ties 104 during storage and transport, but also avoids wasting the lower portion 156 of the box, as the lower portion 156 is a stand-alone unit and can be used as a separate dispensing apparatus 600*b*. In an exemplary embodiment, perforation lines 152 are shown as slanted lines relative to box 650, and so intermediate panel 610 is canted with respect to a plane that is parallel to front surface 664 of box 650. However, in other embodiments, the perforation lines can be oriented straight across the width of box 150, 650. Moreover, the perforation lines need not be linear; they may be curved, wavy, or have any other suitable configurations.

In an exemplary embodiment, box 650 has two images 114 provided on front surface 664, such as by printing. The two images 114 are in a flipped orientation with respect to each other, so that their respective upper portions 114 are proximate end surfaces 666. Image 114 on upper box portion 154 is oriented so that end surface 666*a* is "up" with respect to the image. Image 114 on lower box portion 156 is oriented so that end surface 666*b* is "up" with respect to the image. On upper box portion 154, an upper portion 114*a* of the image 114 is provided on upper box portion 154 and a lower portion 114*b* of image 114 is provided on intermediate panel 610. On lower box portion 156, an upper portion 114*a* of the image 114 is provided on lower box portion 156 and a lower portion 114*b* of image 114 is provided on intermediate panel 610. In an exemplary embodiment, the lower portions 114*b* of the two images on intermediate panel 610 are identical but flipped versions of each other. When the upper box portion 154, the lower box portion 156, and intermediate panel 610 are connected along perforation lines 152, the two images 114 of a stylized capital letter "B" appear uninterrupted on the front surface 664. As shown in FIG. 7, in an exemplary embodiment, twist ties 104 of each of the sub-assemblies 600*a*, 600*b* also have at least lower portion 114*b* of image 114 provided thereon. Accordingly, even after intermediate panel 610 has been removed and discarded, a viewer of the remaining sub-assemblies 600*a*, 600*b* observes an uninterrupted image 114 on each. In an exemplary embodiment, overlay registration of the image 114 is provided on box 650 and twist ties 104. In an exemplary embodiment, a tie web sheet 106 providing the twist ties 104 is printed with the entire image 114, even if only the lower portion of the image 114*b* is visible in display for use (e.g., as shown in FIG. 7).

The figures used in the present application are schematic drawings, where location of the various components can be varied as necessary to accommodate the desired objects to be stored therein. It should be noted that the elements and/or assemblies of the dispensing apparatus can be connected with suitable fasteners as necessary to allow the storage device to be shipped in a disassembled state. Although the subject matter has been described in a language specific to structure features and/or methodological acts, it is to be understood that the subject matter defined in the appended claims is not necessarily limited to the specific features or acts described above as has been determined by the courts. Rather, the specific features and acts described above are disclosed as example forms of implementing the claims.

Although the present disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. Commonly assigned U.S. Provisional Patent Application Ser. No. 62/020,535, filed Jul. 3, 2014, entitled "Twist Tie Dispensing Apparatus and Method," is hereby incorporated by reference.

The invention claimed is:

1. An apparatus, comprising:

a stack comprising a plurality of connected tie web sheets, wherein each tie web sheet comprises a plurality of twist ties, each twist tie having a proximal end and a distal end, each twist tie being removably attached to the stack at its proximal end;

an image disposed on each of the tie web sheets, wherein the image is the same on each tie web sheet and is disposed in overlay registration from sheet to sheet; and a container that surrounds at least the proximal ends of the plurality of twist ties, wherein at least a first portion of the image is disposed on an outer surface of the container overlying the stack and is disposed in overlay registration with the image disposed on each of the plurality of tie web sheets.

2. The apparatus of claim 1, further comprising a backer card having a front surface, wherein the stack is attached to the backer card and is positioned on the front surface of the backer card, wherein the image is disposed on the front surface of the backer card in overlay registration with the image disposed on each of the plurality of tie web sheets.

3. The apparatus of claim 1, wherein the image spans across at least some of the plurality of twist ties.

4. The apparatus of claim 1, wherein the plurality of tie web sheets are connected by a repositionable adhesive.

5. The apparatus of claim 1 further comprising a hang tab.

6. An apparatus including:

a stack comprising a plurality of connected tie web sheets, wherein each tie web sheet includes a plurality of twist ties, each twist tie having a proximal end and a distal end, each twist tie being removably attached to the stack at its proximal end;

an image disposed on each of the tie web sheets, wherein the image is the same on each tie web sheet and is disposed in overlay registration from sheet to sheet; and a container that surrounds at least the proximal ends of the plurality of twist ties, wherein at least a first portion of the image is disposed on the container;

wherein the container comprises a first perforation line demarcating a first portion of the container and a second portion of the container;

wherein the first portion of the image is disposed on the first portion of the container; and wherein a second portion of the image is disposed on the second portion of the container.

7. The apparatus of claim 6, wherein the container comprises a second perforation line demarcating the second portion of the container and a third portion of the container; and wherein the first portion of the image is disposed on the third portion of the container.

8. The apparatus of claim 7, wherein the first portion of the image disposed on the third portion of the container is a flipped version of the first portion of the image disposed on the first portion of the container.

9. The apparatus of claim 6, further comprising a backer card having a front surface, wherein the stack is attached to the backer card and is positioned on the front surface of the backer card, wherein the image is disposed on the front surface of the backer card in overlay registration with the image disposed on each of the plurality of tie web sheets.

10. The apparatus of claim 6, wherein the image spans across at least some of the plurality of twist ties.

11. The apparatus of claim 6, wherein the plurality of tie web sheets are connected by a repositionable adhesive.

12. The apparatus of claim 6 further comprising a hang tab.

* * * * *